US005277083A

United States Patent [19]

Madonia

[11] Patent Number: 5,277,083

[45] Date of Patent: Jan. 11, 1994

[54] APPARATUS FOR FACILITATING OPENING OF PULL TAB CANS

[76] Inventor: Joseph Madonia, 13666 Brougham Dr., Sterling Heights, Mich. 48312

[21] Appl. No.: 47,694

[22] Filed: Apr. 14, 1993

[51] Int. Cl.[5] ..... B67B 7/44

[52] U.S. Cl. ..... 81/3.09; 81/3.55

[58] Field of Search ..... 81/3.07, 3.09, 3.55, 81/3.57, 3.4

[56] References Cited

U.S. PATENT DOCUMENTS

| | | | |
|---|---|---|---|
| 4,253,352 | 3/1981 | O'Neal | 81/3.55 |
| 4,391,167 | 7/1983 | Bergmeister | 81/3.55 |
| 4,412,464 | 11/1983 | Cook | 81/3.55 |
| 4,607,407 | 8/1986 | Bergmeister | 81/3.55 |
| 5,095,777 | 3/1992 | Osmar et al. | 81/3.09 |
| 5,205,194 | 4/1993 | Rodey | 81/3.09 |

*Primary Examiner*—Roscoe V. Parker

*Attorney, Agent, or Firm*—Peter D. Keefe; William D. Blackman

[57] ABSTRACT

A tool for assisting people in opening pull tab actuated cans of two types. The tool is provided with structural features for engaging a pull tab ring to facilitate pivotal movement of a pull tab. The tool is also provided with structural features including a hook for engaging a pull tab ring of a pull tab to facilitate substantially linear movement of the pull tab for removing tear-away lids of cans so equipped.

10 Claims, 2 Drawing Sheets

APPARATUS FOR FACILITATING OPENING OF PULL TAB CANS

BACKGROUND OF THE INVENTION

1. Field of the Invention:

The present invention relates to a tool for facilitating the opening of pull tab cans. More particularly, the present invention relates to a tool which is operable to assist a user in both pivotally rotating pull tabs and linearly pulling pull tabs.

2. Description of the Prior Art:

Pull tabs, as openers on cans housing a variety of products, have been in public use for a number of years. As shown in FIG. 10, a pull tab normally includes a ring 2 which has an opening 4 formed therein to receive a finger of a user therethrough. The ring 2 is attached to a can lid portion 6 by a rivet 8 or the like. Generally speaking, there are two common types of cans with pull tab actuators.

The first type of pull tab actuated can provides a limited size opening in the can lid for drinking or pouring out the liquid contents of the can. This "small opening" can is opened by pivotally rotating the pull tab to break a seal around the small opening and to force a tear-away portion of the lid downwardly into the can, the tear-away portion of the lid remaining attached, at one thereof, to the remainder of the can lid.

The second type of pull tab actuated can which is commonly available today is a "tear-away lid" type in which the entire upper surface or lid of the can is removable in a two-step process. When removing the lid from this second type of can, the pull tab is first pivotally rotated to break a seal at the edge of the lid, in a manner similar to that used to open the small opening type of can. Then, once the seal has been broken, the user pulls substantially linearly on the pull tab to tear the lid away from the can along a scored groove provided around the outer edge of the lid. In removing the lid from this type of can, it is worth noting that the edge of the tear-away lid may be razor sharp, and may pose some safety hazard unless it is carefully handled and disposed of. Some examples of products which are sold in the "tear-away lid" type of can include cat food, individually packaged pudding servings and fruit cups, vienna sausages, and other products which generally share the characteristic of not being 100% liquid, i.e., these products all include some non-liquid ingredients which necessitates complete removal of the can lid in order to access the contents of the can.

While pull tab actuated cans are convenient and do not require the use of an extraneous can opener, people with limited strength or with limited manual dexterity, or people who wish to protect their nails from potential breakage, would benefit from the provision of a tool that could facilitate the opening of pull-tab actuated cans, particularly if such a tool would assist a user in opening the tear-away lid type of can as well as the small opening type of can. In addition, because of the extreme sharpness of the tear-away lids, as noted above, it would be advantageous to have a tool for opening the tear-away lid cans which would keep the hand of a user as far from the sharp edge of the lid as possible. Ideally, such a tool would assist a user both in pivotally rotating pull tabs and in linearly pulling pull tabs, because of the two types of motion involved in opening cans of the tear-away variety, as noted hereinabove.

SUMMARY OF THE INVENTION

The present invention provides a tool for assisting users in opening pull tab cans of both the small opening and tear-away lid types. The tool in accordance with the present invention is generally composed of a graspable body portion and means attached to the body portion for engaging a pull tab to facilitate pivotal movement of the pull tab. Additionally, the tool may include means attached to the body portion for engaging a pull tab to facilitate substantially linear pulling of the pull tab and further may include means attached to the body portion for assisting bending of the tear-away portion of the lid into the can.

In a preferred embodiment of the present invention, the engaging means which facilitates pivotal movement comprises a flattened opening formed in one end of the body for receiving a pull tab therein, and the engaging means which facilitates substantially linear movement comprises a projection extending outwardly from the body portion and defining a hook for passing through a pull tab ring. In a particular embodiment of the present invention, a push tab extends forwardly from the body above the flattened opening for pushing downwardly on the tear-away portion of the can lid.

For a more complete understanding of the present invention, the reader is referred to the following detailed description section, which should be read in conjunction with the accompanying drawings. Throughout the following description and in the drawings, like numbers refer to like parts throughout the several views.

DETAILED DESCRIPTION OF THE PREFERRED EMBODIMENTS

Figure 1:
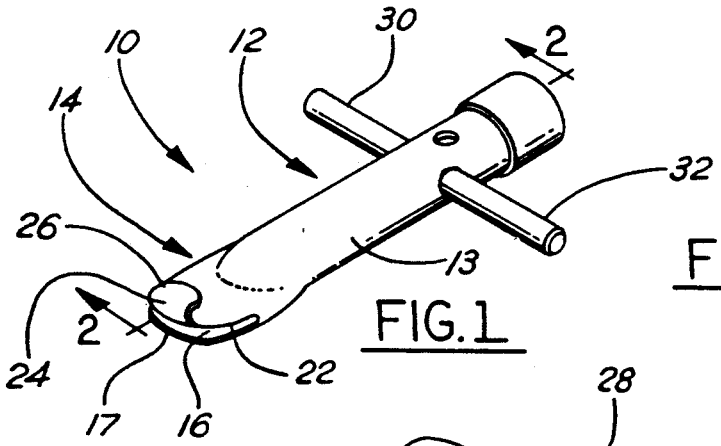
FIG. 1 is a perspective view of a first embodiment of the tool in accordance with the present invention.

Referring now to FIGS. 1 through 5 of the drawings, a first embodiment of the present invention is indicated by tool 10. The tool 10 comprises a body portion or body 12 which is graspable by a user 28 of the tool 10. The body 12 is not required to be of any particular shape, and is preferably formed from a rigid durable material such as metal or a high-strength plastic. While the body 12 is depicted in the drawings as being generally cylindrical in shape, other shapes may be used so long as they function in an equivalent manner and include a fattened opening which corresponds to that shown at 16. It is preferred that the body shape be somewhat elongated, in order to function as a lever.

Figure 2:
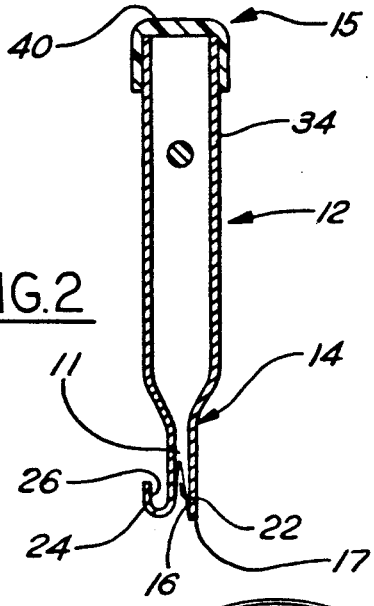
FIG. 2 is a cross-sectional view of the tool taken along line 2—2 in FIG. 1.
Figure 3:
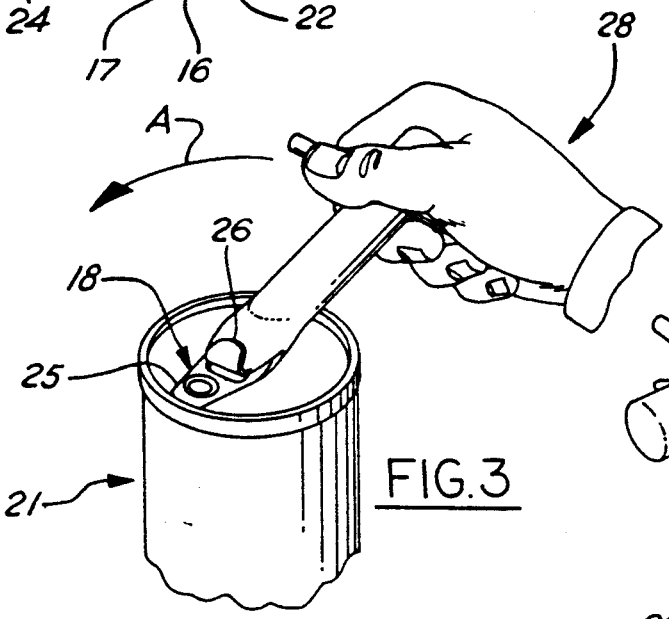
FIGS. 3 through 5 are perspective views of the first embodiment of the tool, shown in use opening a can.

The body 12 has a first end 14 with a flattened opening formed therein for guidably receiving the ring 19 of a pull tab 18 therein to facilitate pivotal movement of the pull tab 18 as depicted in FIG. 3. As shown in FIG. 2, the flattened opening 16 leads into a substantially plate-like internal chamber 11 formed within the interior of the first end 14. The first end 14 with the flattened opening 16 formed therein provides a guide for facilitating pivotal movement of a pull tab 18 when applied thereto. The entire body 12 may be hollow inside, as shown, if it is formed from a material having sufficient strength and rigidity, but the present invention does not require any part of the body, other than the first end 14, to be hollow.

In this first embodiment of the tool 10 of the present invention, the first end 14 has side slots 22, 23 formed therein on opposite sides of the flattened opening 16. While only one side slot 22 is visible in FIG. 1, the other side slot 23 is substantially identical and is visible in FIG. 4. The side slots 22, 23 communicate with the plate-like internal chamber 11 and with the flattened opening 16 to accommodate pull tabs 18 of different sizes. By providing the side slots 22, 23 at the first end 14 of the body 12, a pull tab ring 19 having a width that is wider than the predetermined width of the first end 14 can overlap the tool 10 on one or both side slots 22, 23 thereof so as to still fit the larger width pull tab ring into the plate-like internal chamber 11. The side slots 22, 23 are optional and are not required in the practice of the present invention.

Another optional feature which may be provided on the tool 10 is a pair of gripping extensions 30, 32 attached to opposite sides of the body 12 to give a user something further to grab hold of besides the body itself, thereby improving the user's grip for pulling on the tool 10. While the gripping extensions 30, 32 are shown as cylindrical shafts which are disposed transverse to the body 12, the reader will realize that other shapes (curved arms, knobs, widening of the body, sculpted finger grips, etc.) would function in an equivalent manner, and could be substituted for the gripping extensions 30, 32 shown, without departing from the scope of the present invention.

The body 12 has a second end 15 disposed opposite the first end 14. An end cap 40 may also be optionally provided on the second end 15 of the body 12. Where used, the end cap 40 is preferably formed of a resilient material, such as rubber or other appropriate elastomer, and serves to protect a user 28 against any sharp edges which may be present on the body 12.

A projection 24 extends forwardly from the first end 14 of the body 12 adjacent the flattened opening 16, and turns back toward the second end 15 to define a hook 26 for engaging a ring 19 of a pull tab 18, as will be further described hereinbelow. In the structure and function of a tool 10 in accordance with the present invention, the projection 24 and associated hook 26 could be equivalently located elsewhere, such as at the second end 15 of the body 12 without departing from the scope of the present invention. In this first embodiment of tool 10, the projection 24 is disposed substantially above the lower front edge 17 of the body 12, as shown in FIG. 1, and does not extend forward of the lower front edge 17.

The body 12 further includes a central section 13 which interconnects the first end 14 and the second end 15. The central section 13 serves to elongate the body 12 so as to provide a graspable member and to define a lever arm which facilitates pivotal movement of a pull tab 18. Where used, the gripping extensions 30, 32 are preferably attached to the central section 13 of the body 12.

Figure 4:
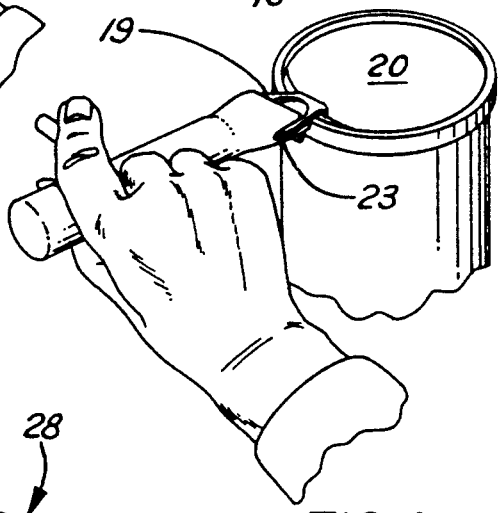
Figure 5:
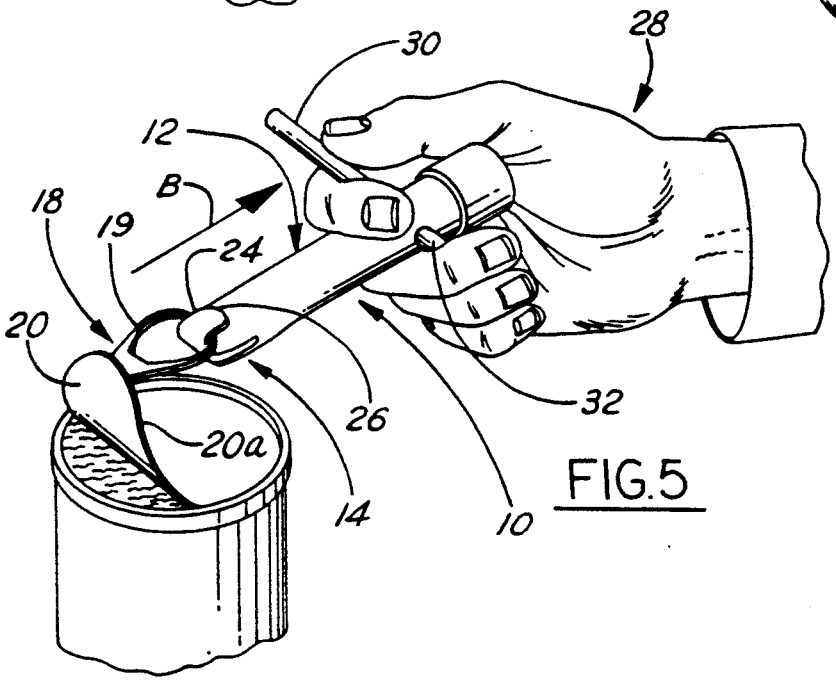

When using the tool 10 of the present invention to open a pull tab 18 actuated can of the tear-away lid type as shown in FIGS. 3 through 5, the pull tab ring 19 thereof is first slidably inserted into the flattened opening 16 as far as possible so that the pull tab ring is guidably seated within the plate-like chamber of the first end of the body. The tool 10 and pull tab 18 are then pivotally moved as a unit in a direction along arrow A to force the base 25 of the pull tab 18 downwardly into the can 21 to break a seal at the edge **20*a* of the lid 20**.

After the seal has been broken, the tool 10 is reoriented so as to place the hook 26 through the pull tab ring 19 of the pull tab 18, as illustrated in FIG. 5, and a lateral pulling force is thereupon applied along arrow B to remove the lid 20. It will be appreciated that the tool 10 of the present invention could be combined with more conventional bottle openers and punch-type can openers, to form a multi-purpose tool (not shown).

Figure 6:
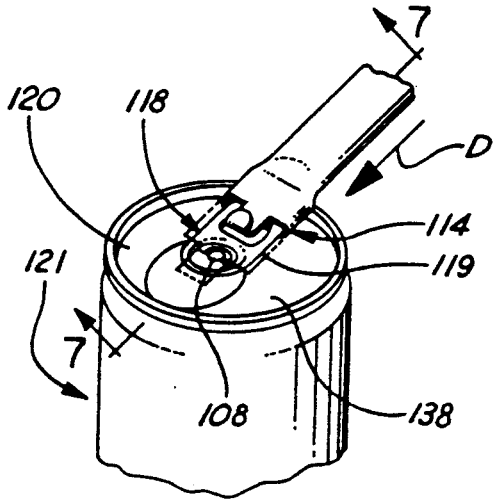
FIG. 6 is an environmental view of a second embodiment of the tool in accordance with the present invention, shown opening a can.
Figure 7:
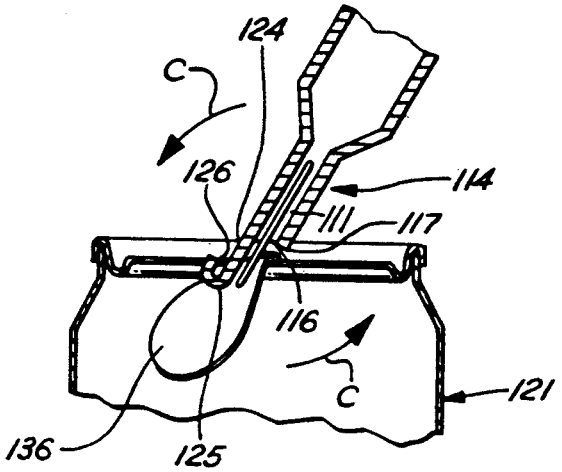
FIG. 7 is a cutaway cross-sectional view of the tool taken along the line 7—7 in FIG. 6.
Figure 8:
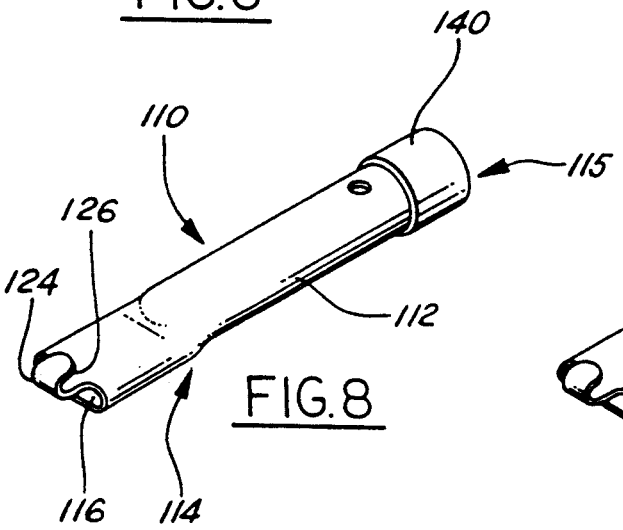
FIG. 8 is a perspective view of the second embodiment of the tool.

Referring now to FIGS. 6 through 8, a second embodiment of a tool 110 in accordance with the present invention is shown. Where not specifically discussed herein, the second embodiment of the tool 110 is substantially identical with the first embodiment of the tool 10 as described hereinabove. The tool 110 includes a substantially cylindrical body 112 which is provided with a first end 114 having a flattened opening 116 formed therein. The flattened opening 116 is structured to guidably receive a pull tab ring 119 of pull tab 118 therein in order to facilitate pivotal movement of the pull tab. Adjacent the flattened opening 116, a projection 124 extends forwardly from the body 112, beyond the lower edge 117 of the first end 114, in a direction substantially parallel with respect to the plate-like internal chamber 111 so as to form a push tab 125 (see FIG. 7). The push tab 125 is provided for facilitating application of a downward force by a user to the tear-away portion 136 of a small opening can 121, as shown particularly in FIG. 7. The projection 124 curves upwardly from the push tab 125 to form a hook 126 for engaging the pull tab ring 119 of a pull tab 118, so as to facilitate pulling of the pull tab ring in a substantially linear direction, as disclosed hereinabove relative to a tear away lid type of can. In this second embodiment of the tool 110, the hook 126 is not required to be attached to the projection 124 as shown, but could be located elsewhere on the body, such as attached to the second end 115. However, this second embodiment of tool 110 does require the push tab 125 to be located above and extend forwardly beyond the lower edge 117 of the body so that the tear-away portion 136 is abutted thereby when opening a can. As previously noted in the first embodiment of the tool 10, the projection 24 is disposed substantially above the lower front edge 17 of the first end 14; in contrast, the structure of the second embodiment of the tool 110 is such that the push tab 125 extends substantially forward of the lower front edge 117 of the first end 114. This configuration is provided to allow the push tab 125 to push downwardly on the tear-away portion 136 of a can lid 20 as the pull tab 118 is pivoted along arrows C in FIG. 7 around the rivet 108 which attaches the pull tab 118 to the can 121.

FIG. 6 illustrates the tool 110 in operation, wherein the tool is being slidably installed on a can 121. In use, a user of the tool 110 aligns the flattened opening 116 with the ring 119 of the pull tab 118 and the tool 110 is then pushed as far as possible in the direction of arrow D in FIG. 6. The position of the tool 110 in the guidably installed position is shown in phantom in FIG. 6, and in cross section in FIG. 7. Once the tool 110 is installed on the pull tab 118, the tool and the pull tab are then rotated together in the direction shown by arrows C in FIG. 7 in order to open the can.

Figure 9:
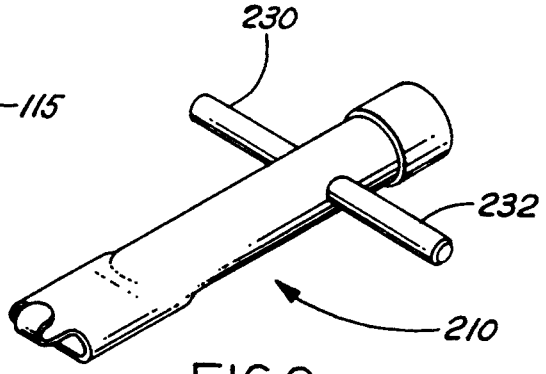
FIG. 9 is a perspective view of a third embodiment of the tool in accordance with the present invention.
Figure 10:
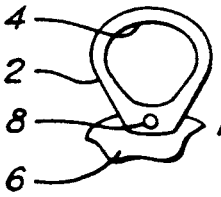
FIG.10 PRIOR ART
FIG. 10 is a perspective view of a pull tab, showing the relevant component parts thereof.

Referring now to FIG. 9, a third embodiment of the tool 210 according to the present invention is shown. This embodiment of the tool 210 is substantially identical to the second embodiment of the tool 110 as described hereinabove, with the additional feature of a pair of gripping extensions 230, 232 similar to those described in connection with the first embodiment of the tool 10.

Figure 11:
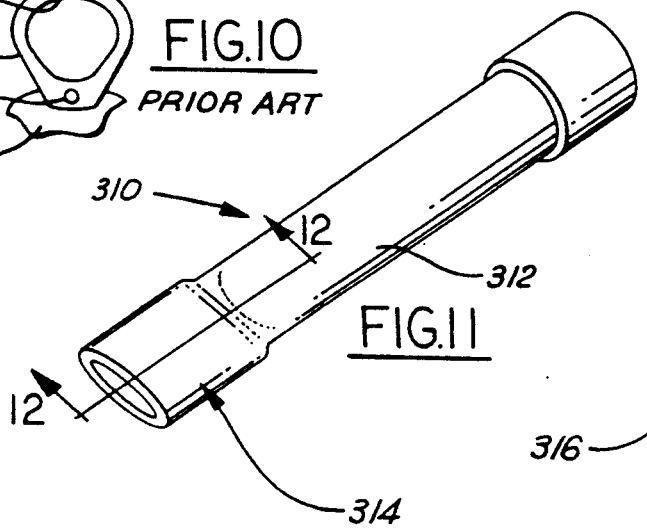
FIG. 11 is a perspective view of a fourth embodiment of the tool in accordance with the present invention.
Figure 12:
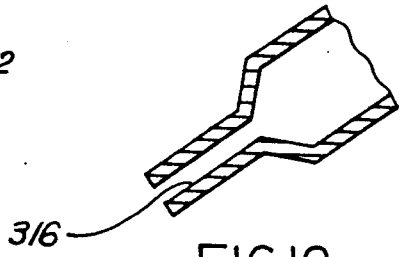
FIG. 12 is a cutaway perspective view of the tool, taken along line 12—12 in FIG. 11.

Referring now to FIGS. 11 and 12, a fourth embodiment of the tool 310 according to the present invention is shown, which is used to assist users in operating the small opening type of pull tab actuated cans. The tool 310 is formed from a generally cylindrical piece of metal tubing which provides a body 312, the body having one end 314 flattened to create a flattened opening 316 therein for receiving a pull tab ring therein in the manner described hereinabove. In use, a pull tab ring is inserted into the flattened opening 316 as far as possible and then the tool 310 and the pull tab ring are pivotally rotated as a unit to break a seal and open the can. The tool 310 thus provides a lever arm to facilitate pivotal movement of the pull tab. The tool 310 is also preferably provided with an end cap 340. While the tool 310 is favored for its simplicity in assisting a user to pivotally rotate pull tabs, it cannot be used as depicted to pull upon a pull tab of a can of the tear-away lid variety.

Although the present invention has been described herein with respect to preferred embodiments hereof, it will be understood that the foregoing is intended to be illustrative, and not restrictive. Many modifications of the present invention will occur to those skilled in the art. For instance, any of the tool embodiments disclosed herein may be provided with side slots 22, 23, wherein such side slots are structured substantially as shown in FIG. 1. All such modifications which fall within the scope of the appended claims are intended to be within the scope and spirit of the present invention.

What is claimed is:

1. A tool for assisting a user to open cans having a lid provided with a pull tab, the pull tab having a pull tab ring, wherein the lid of the can may have a tear-away portion connected with the pull tab, said tool comprising:

a body portion having a first end and an opposite second end, said body portion being structured for being grasped by a user;

pivotal movement means attached to said body portion for guidably engaging a pull tab ring of a pull tab of a can to facilitate pivotal movement of the pull tab relative to the can so as to provide at least in part opening of the can, wherein said pivotal movement means comprises said first end having a flattened opening therein, said flattened opening provided a plate-like internal chamber in said body portion dimensioned for guidably receiving the pull tab ring therewithin;

linear movement means attached to said body portion for engaging the pull tab ring so as to facilitate substantially linear movement of the pull tab away from the can in order to provide at least in part removal of the lid from the can; and push tab means projecting from said first end for pressing against a tear-away portion of the lid during said pivotal movement of the pull tab so as to aid bending of the tear-away portion of the lid into the can;

wherein said first end is provided with a lower edge at said flattened opening; further wherein said push tab means comprises a push tab projecting from said first end at a location opposite said lower edge, said push tab extending beyond said lower edge in a direction substantially parallel with respect to said plate-like internal chamber; and wherein said linear movement means is connected with said push tab.

2. The tool of claim 1, wherein said linear movement means comprises a hook.

3. The tool of claim 2, wherein said first end of said body portion has a predetermined width; wherein further said first end is provided with a pair of side slots formed therein, each side slot of said pair of side slots communicating with said flattened opening and said plate-like internal chamber, each side slot of said pair of side slots being mutually oppositely disposed with respect to said first end, said pair of side slots being dimensioned for receiving pull tab rings having a width exceeding said predetermined width.

4. The tool of claim 3, further comprising gripping means connected with said body portion for providing a handhold.

5. The tool of claim 4, wherein said gripping means comprises a pair of gripping extentions extending outwardly from said body portion, each gripping extension of said pair of gripping extensions being mutually oppositely disposed with respect to said body portion.

6. A tool for assisting a user to open cans having a lid provided with a pull tab, the pull tab having a pull tab ring, wherein the lid may have a tear-away portion connected with a pull tab, said tool comprising:

a body portion having a first end and an opposite second end, said body portion being structured for being grasped by a user;

pivotal movement means attached to said body portion for engaging a pull tab ring of a pull tab of a can to facilitate pivotal movement of the pull tab relative to the can so as to provide at least in part opening of the can, wherein said pivotal movement means comprises said first end having a flattened opening therein, said flattened opening providing a plate-like internal chamber in said body portion dimensioned for guidably receiving the pull tab ring therewithin, said first end being provided with a lower edge at said flattened opening;

linear movement means attached to said body portion for engaging the pull tab ring so as to facilitate substantially linear movement of the pull tab away from the can in order to provide at least in part removal of the lid from the can; and push tab means projecting from said first end for pressing against a tear-away portion of the lid during said pivotal movement of the pull tab ring so as to aid bending of the tear-away portion of the lid into the can, said push tab means comprising a push tab projecting from said first end at a location opposite said lower edge, said push tab extending beyond said lower edge in a direction substantially parallel with respect to said plate-like internal chamber;

wherein said linear movement means is connected with said push tab.

7. The tool of claim 6, wherein said linear movement means comprises a hook.

8. The tool of claim 7, wherein said first end of said body portion has a predetermined width; wherein further said first end is provided with a pair of side slots formed therein adjacent said flattened opening, each side slot of said pair of side slots communicating with said flattened opening and said plate-like internal chamber, each side slot of said pair of side slots being mutually oppositely disposed with respect to said first end, said pair of side slots being dimensioned for receiving pull tab rings having a width exceeding said predetermined width.

9. The tool of claim 8, further comprising gripping means connected with said body portion for providing a handhold.

10. The tool of claim 9, wherein said gripping means comprises a pair of gripping extensions extending outwardly from said body portion, each gripping extension of said pair of gripping extensions being mutually oppositely disposed with respect to said body portion.

* * * * *